US005902067A

United States Patent [19]

Rushing

[11] Patent Number: 5,902,067

[45] Date of Patent: May 11, 1999

[54] LIGHTED TUBE SUPPORT ASSEMBLY

[76] Inventor: Hollis B. Rushing, 4913 Woodlake Dr., Baton Rouge, La. 70817

[21] Appl. No.: 08/975,006

[22] Filed: Nov. 20, 1997

[51] Int. Cl.[6] ..... E01F 9/016; E01F 15/02

[52] U.S. Cl. ..... 404/6; 256/13.1; 362/152

[58] Field of Search ..... 404/6, 9, 12; 256/1, 256/13.1; 362/152; 116/63 R

[56] References Cited

U.S. PATENT DOCUMENTS

| | | | |
|---|---|---|---|
| D. 348,737 | 7/1994 | Yang | 256/13.1 |
| 4,338,041 | 7/1982 | Schmanski | 404/9 |
| 5,181,695 | 1/1993 | Arthur | 256/13.1 |
| 5,641,241 | 6/1997 | Rushing | 404/6 |

*Primary Examiner*—James A. Lisehora
*Attorney, Agent, or Firm*—Garvey, Smith, Nehrbass & Doody, LLC

[57] ABSTRACT

A lighted tube support assembly having a first base portion and an upper lighted tube support portion. The base portion would be substantially rectangular in configuration, and would define a channel therethrough of sufficient width to accommodate the width of an anti-glare panel therein. The lighted tube support portion would include a continuous ring member having a bore therethrough for slidably engaging around the outer surface of a lighted tube, and the support portion would further be secured to the base portion via a ball and socket type of joint, so that the upper tube support portion could rotate in vertical, horizontal, and rotational planes in relation to the stationary base member. It would be further provided that these assemblies would be spaced at regular intervals along the entire length of the lighted tube, and would be secured to the support structure or anti-glare panel via screws or the like attachment.

20 Claims, 4 Drawing Sheets

LIGHTED TUBE SUPPORT ASSEMBLY

BACKGROUND OF THE INVENTION

1. Field of the Invention

The apparatus and assembly of the present invention relates to lighted guidance systems for highways. More particularly, the apparatus relates to a support assembly for supporting a lighted tube mountable on anti-glare panels on portions of a highway to alert drivers to be cautious at that particular portion of the highway.

2. General Background of the Invention

In the development of the highway system, particularly in the United States, there are constant upgrades, reconstruction and new construction of portions of the highway system, particularly on the interstate system. Of course, while this type of upgrade or construction is ongoing, the various state highway departments attempt to maintain the highway open to traffic, yet are very vigilant in alerting drivers to the construction that is ongoing in a particular section of the highway. For example, one problem that has arisen is in instances when traffic is routed from a four lane highway to a two lane section of highway while the highway is undergoing repair. It is common that one of the four lane sections must be merged into the other four lane section, and commence to a two lane section. At the point of merger, while the traffic is moving from an entrance lane onto the highway, particularly at night, the oncoming traffic is often blinded by the lights of the car merging onto the highway. Therefore, there has been patented a device known as an anti-glare panel, U.S. Pat. No. 5,641,241 entitled "Lighted Anti-Glare Paddle System" which is positioned on a median, and is angulated so that a plurality of these anti-glare panels forms a continuous wall effect between the lanes, and therefore the lights of the merging traffic do not interfere with the ongoing traffic. Another important instance where highway warnings are important are sharp turns or elevated turns on an interstate system, which may result in a vehicle miscalculating speed around the turn and making contact with the sidewall of the turn, or often times at night time, not appreciating that the turn is upcoming and again, results in an accident. In these particular instances, there has been devised a particular warning system known as a lighted guidance system, which is a continuous tube extending along the wall, for example, of a walled turn in a highway, where the lighted tube containing a phosphorescent or glowing material therein, serves as a lighted alert when the automobile approaches the turn and the driver is alerted that the turn, is upcoming due to the glowing material within the tube. Often times, these tubes may be used in conjunction with the system of anti-glare panels as was discussed earlier.

One of the problems that is confronted with the use of such tubes on highway systems is the manner in which the tubes are mounted onto the anti-glare panel system on the highway. For example, if there is an attempt to mount a continuous lighted tube, which may be of several hundred feet in length along a certain portion of highway over the length of the tube, the tube may undergo turns and bends which would make it difficult to mount it on a continuous basis due to the various turns in the tube along its path. Therefore, there is a need for a support bracket which would enable a continuous lighted tube to be mounted adjacent a highway on anti-glare panels which would accommodate the various twists and turns that the tube may undergo, yet still insure secure mounting of the tube along its entire length.

BRIEF SUMMARY OF THE INVENTION

The apparatus of the present invention solves the shortcomings in the art in a simple and straightforward manner.

What is provided is a lighted tube support assembly having a first base portion and an upper lighted tube support portion. The base portion would be substantially rectangular in configuration, and would define a channel therethrough of sufficient width to accommodate the width of an anti-glare panel therein. The lighted tube support portion would include a continuous ring member having a bore therethrough for slidably engaging around the outer surface of a lighted tube. The support portion would further be secured to the base portion via a ball and socket type of joint, so that the upper tube support portion could rotate in all planes, vertically, horizontally, and rotationally, in relation to the stationary base member. There would be further provided that these assemblies would be spaced at regular intervals along the entire length of the lighted tube, and would be secured to the support structure or anti-glare panel via screws or the like attachment.

Therefore, it is a principal object of the present invention to provide a lighted tube support assembly which allows for mounting of a continuous lighted tube along a portion of highway along all planes of attachment so as to accommodate bends and turns in the lighted tube along its path;

It is a further object of the present invention to provide a simply constructed, light weight lighted tube support assembly which is mountable upon standard anti-glare panels, and which would support a continuous lighted tube along its entire length through various vertical, horizontal and rotational adjustments;

It is a further object of the present invention to provide a lighted tube support assembly which is mountable upon anti-glare panels so as to accommodate a continuous length of lighted tube and allow for bends and turns in the tube as the tube is mounted along the highway with a plurality of said assemblies.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
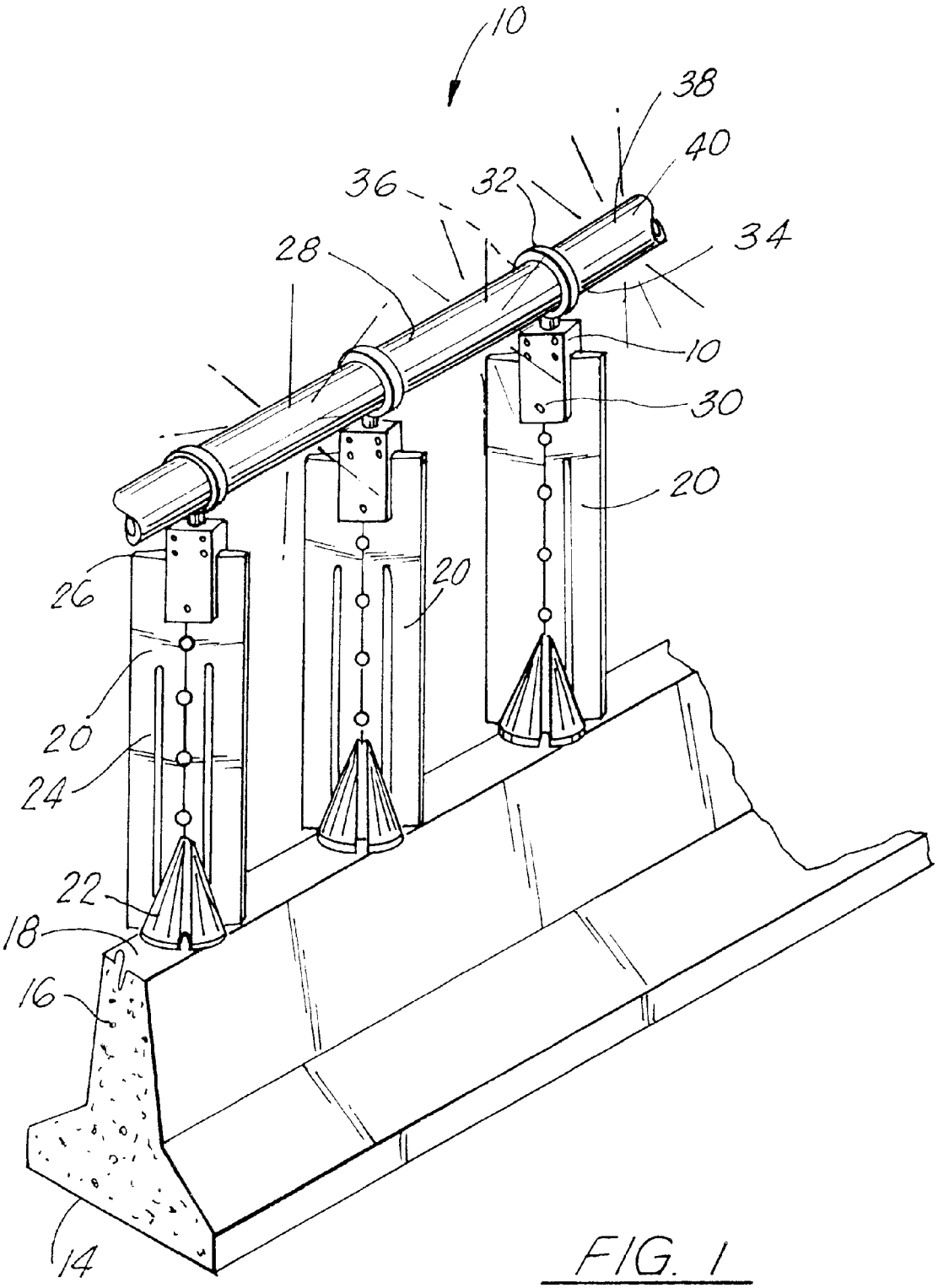
FIG. 1 illustrates an overall view of a plurality of the preferred embodiment of the present invention supporting a continuous lighted tube along a plurality of anti-glare panels.

FIGS. 1–7 illustrate the preferred embodiment of the apparatus of the present invention by the numeral 10. Initially, FIG. 1 illustrates the apparatus of the present invention 10 being utilized in the setting for which it has been developed. As illustrated in FIG. 1, there is seen a concrete or the like medium barrier 12 having a base portion 14 which would rest on the surface along a highway or the like, an upright central portion 16, terminating in a flat upper surface 18. In normal use, such a divider would be placed along intermediate lanes in a two lane highway so that traffic could move in both directions without the possibility of cars inadvertently moving into the oncoming lanes. This type of barrier is usually used when there is ongoing construction on the highway and in some case, is a temporary placement while the highway is being repaired.

Further, as illustrated in FIG. 1, there is seen an anti-glare panel 20 which could be of the type that is disclosed in U.S. Pat. No. 5,641,241, owned by Gulf Industries, Inc., which provides a base portion 22, an anti-glare panel portion 24 which terminates in an upper surface 26. As seen in FIG. 1, there is a plurality (3) of the panels 20, which each of the panels 20 secured in some fashion to the upper surface 18 of barrier 12. In their use, the anti-glare panels are fixed at an angulated position relative to the longitudinal positioning of the barrier 12, so that the traffic on either side of the barrier, or traffic merging onto one of the lanes, would be prevented from blinding the oncoming traffic with headlights or the like. The panels further enable the use of a spaced apart system rather than a complete continuous type of barrier which would be more expensive and may be cost prohibitive.

Further, as illustrated in FIG. 1, there is seen the assembly 10 of the present invention which would be utilized for supporting a lighted tube 28. As illustrated and as will be discussed further, assembly 10 includes a base portion 30 and an upper tube support portion 32, with the upper tube support portion 32 including a ring member 34, having a continuous inner bore 36 therethrough in which the tube 28 is slidably engaged and would be held in place. For purposes of explanation, the tube 28 would be a tube having an outer wall portion 38 and an interior bore 40 in which a phosphorescent material of a type known in the art would be contained so that as the lights shown upon the tube, the tube would glow so as to give drivers of automobiles a more clearer warning of a particular hazard on the highway. This will be discussed further.

Figure 2:
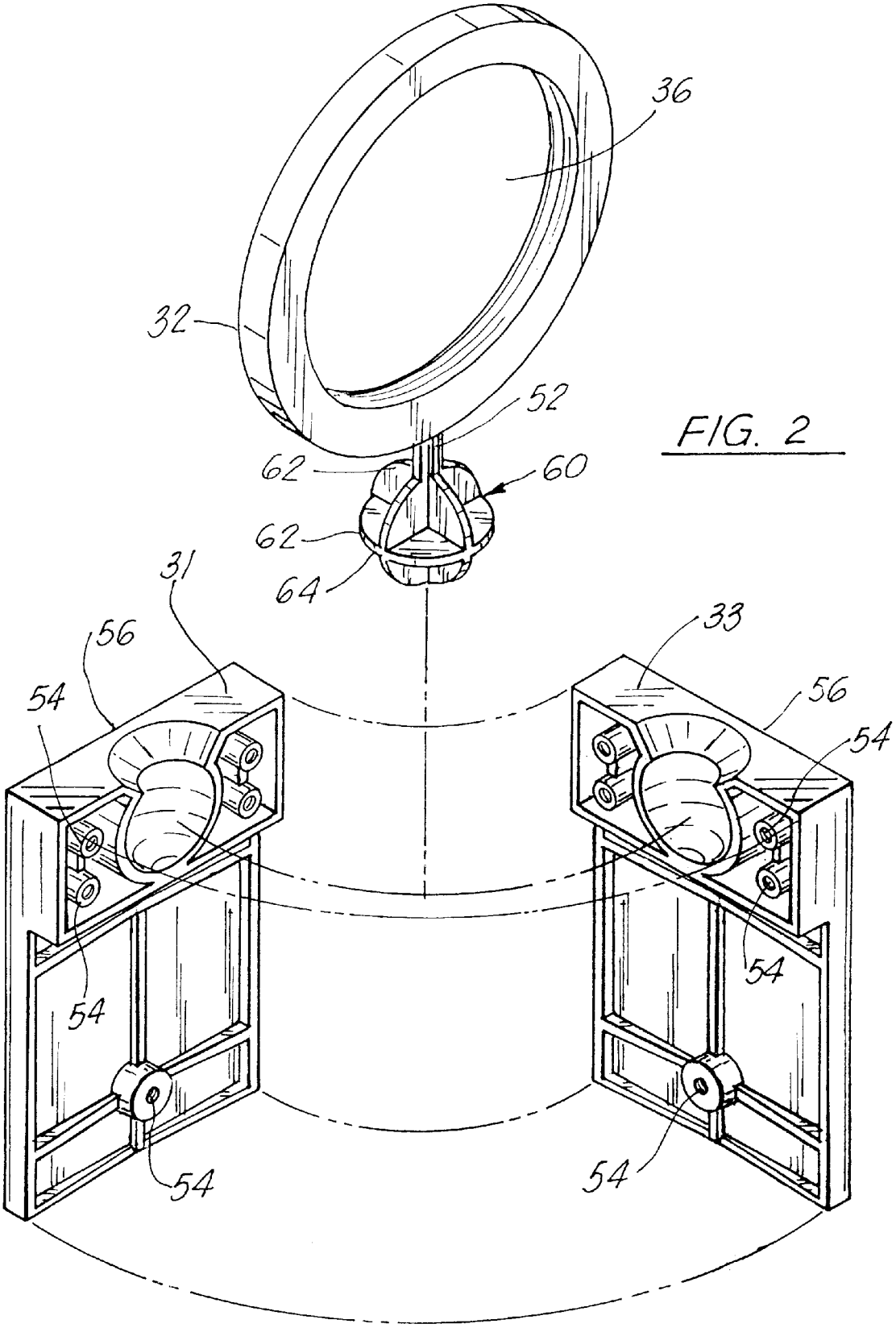
FIG. 2 illustrates an exploded view of the preferred embodiment of the apparatus of the present invention.
Figure 3:
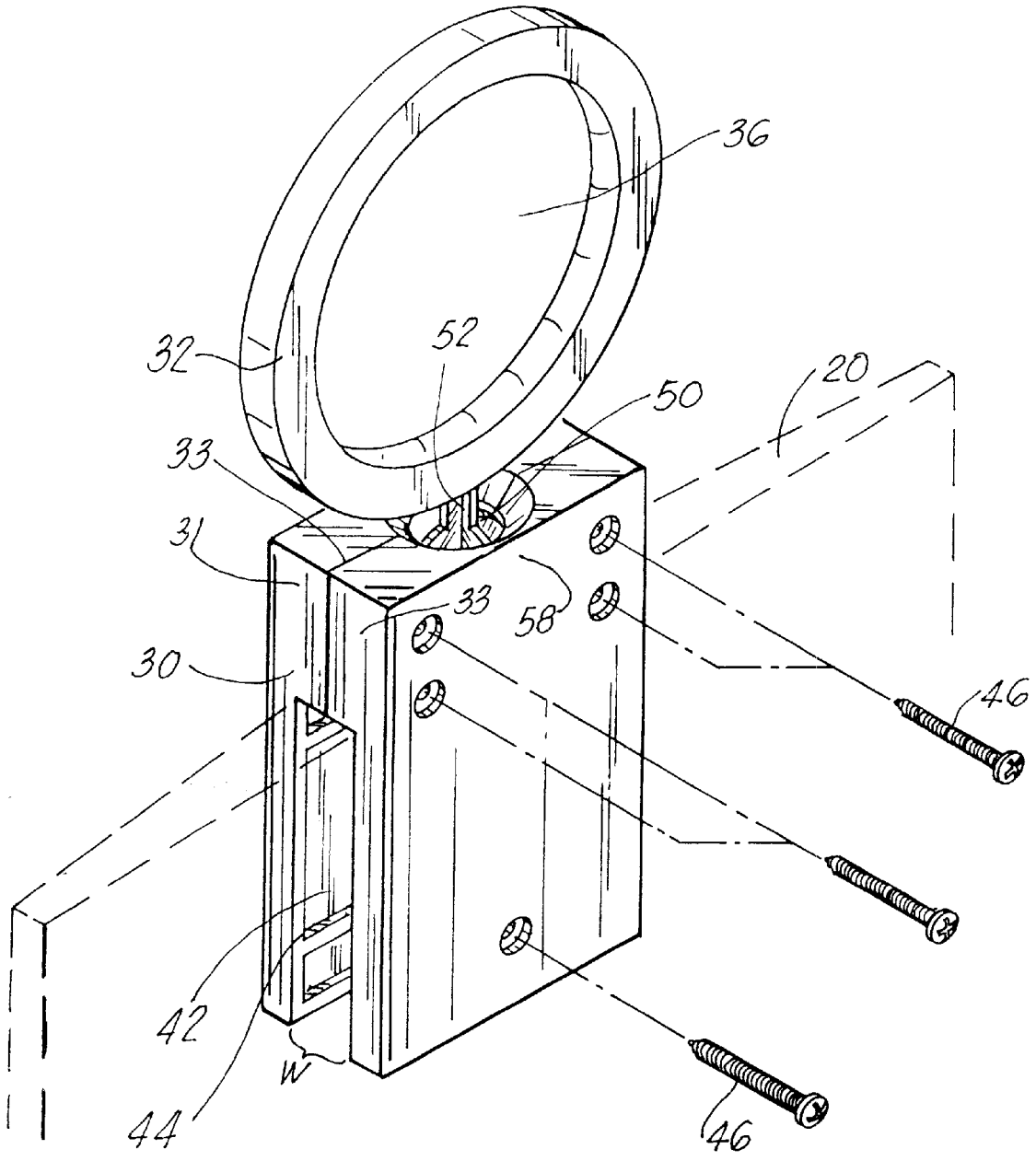
FIG. 3 illustrates an overall view of the support assembly of the present invention mountable on an anti-glare panel.

Turning now to FIGS. 2 and 3 of the application, FIG. 2 illustrates the lighted tube support assembly 10 in greater detail. As was stated earlier, the assembly has a substantially rectangular base portion 30, the base portion 30 supporting a circular upper tube support portion 32 which comprises the continuous ring 34 having an inner bore 36 through which the lighted tube 38 would be positioned as seen in FIG. 1. As further seen in FIG. 2, base 30 further includes a channel 42 formed in its lower portion and extending substantially the greater length of the base with the channel 42 terminating at point 44. The channel 42 formed throughout the portion of the base 30, would be of a sufficient width W so as to be slidably engaged upon a standard anti-glare panel 20, the type as illustrated in FIG. 1. When the base 30 has been slid upon the glare panel 20, there is then included a screw member 46 which is threadably engaged through the base into the glare panel 20 for securing the base 30 thereunto. As seen also in FIG. 2, the base 30, as illustrated, is actually comprised of a first half portion 31 and a second half portion 33, secured together at a common edge 35 and held in place by a plurality of screws 46. As seen further in the Figure, when the halves 31 and 33 are engaged into the single base 30, there is defined an upper circular opening 50, through which a stem member 52 extends outward and is integrally secured to the ring 32. This relationship will be more thoroughly discussed in reference to FIG. 3.

Turning now to FIG. 3, it is illustrated that the unitary base 30 has been opened into its composite parts 31, 33. As seen, the interior of each of the parts 31, 33 include the upper housings 54 which house the individual screws 46 for engaging portions 31, 32 together, as was discussed earlier, and the lower screw housing 54 which houses the screw for engaging onto the anti-glare panel 20. What is of particular interest in the construction of the base is that each of the base portions 31, 33, includes a semi-circular opening 56 which when in the closed position forms a circular cavity 57 within the base 30 as seen in FIG. 2. This circular cavity 57 would engage a circular member 60 which is formed with a plurality of vertical and horizontal partitions 62, which in their outermost edges 64 would define a circular ball member 60 which would be secured into the circular cavity or socket 57 as seen in FIG. 2. This ball and socket relationship is important to the construction and operation of the assembly as will be discussed in FIGS. 4–7.

Figure 4:
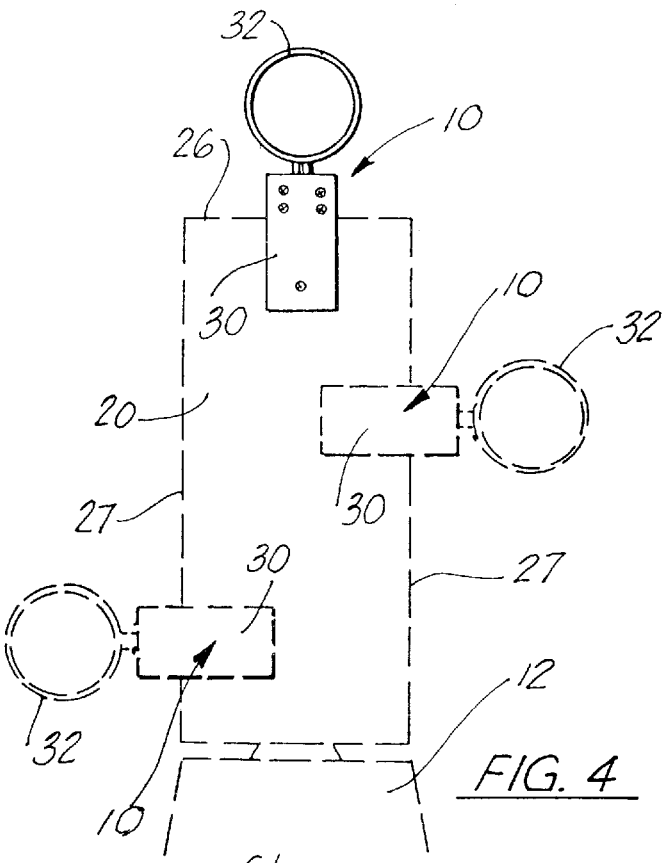
FIG. 4 illustrates a view of the preferred embodiment of the assembly of the present invention mountable in various positions on an anti-glare panel.
Figure 5:
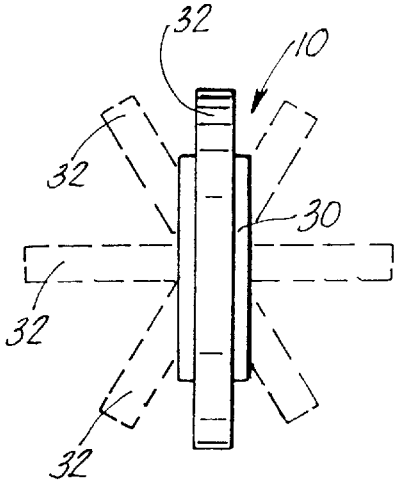
FIGS. 5–7 illustrate views of the horizontal, vertical and rotational adjustability of the upper portion of the lighted tube support assembly relative to its stationary base portion in the preferred embodiment of the present invention.

Turning now to FIGS. 4–7, reference is made, for example, to FIG. 4 where there is illustrated in phantom view a typical anti-glare panel 20 with the assembly 10 mounted, for example, on the upper face 26 of the panel as was described earlier in relation to FIG. 1. However, it will be noted that if necessary, the assembly 10 may be housed either on a left or right side edge 27 as illustrated in FIG. 4, depending on whether or not there is a need to house the lighted tube 28 within ring 32 in that position. More importantly, reference is made to FIGS. 5–7, which, as seen in FIG. 5, there is illustrated in top view the assembly 10 with the base 30 and the ring portion 32. There is also seen in phantom view an illustration of the ring 32, sense that because of the ball and socket relationship between the ring 32 and the base 30, the ring is able to have a complete 365 degree rotational movement as it relates to the stationary base portion 30. This alignment is important in view of the fact that as a lighted tube 28 is extended along a length of highway, the lighted tube 28 may well take left or right turns along its path and therefore, any angulated turn the tube may take, the circular ring 32 may be so positioned somewhere along the 360 degree axis so as to accommodate the turn.

Figure 6:
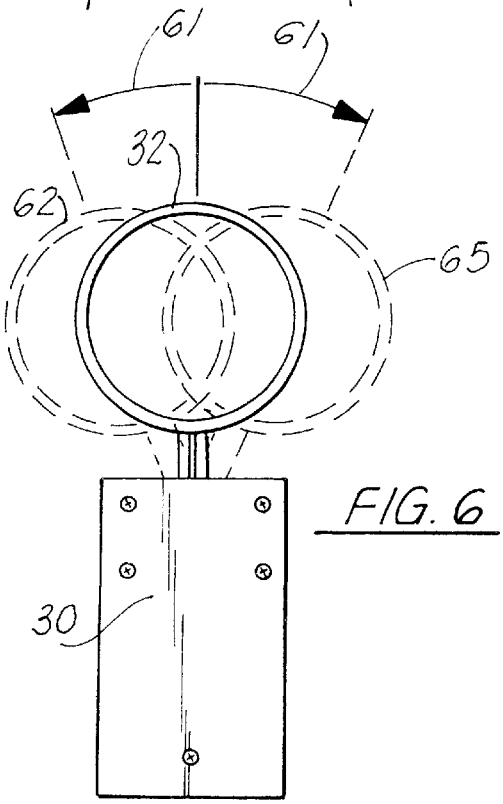

Further, as seen in FIG. 6, there is illustrated the base portion 30 and the ring 32 shown in full view in its complete upright and vertical position in relation to the base 30. However, again because of the ball and socket relationship between the base 30 and the ring 32, the ring 32 is able to rotate in a plane along arrows 61, either in a position left of vertical, as seen in phantom view as 62, or moved in a position right of vertical, as illustrated as 65. Again, this will accommodate any mis-alignment of the tube 32 from the vertical axis as it is illustrated in FIG. 6 to these other positions 62, 64, as the tube 32 travels along its length along the highway.

Figure 7:
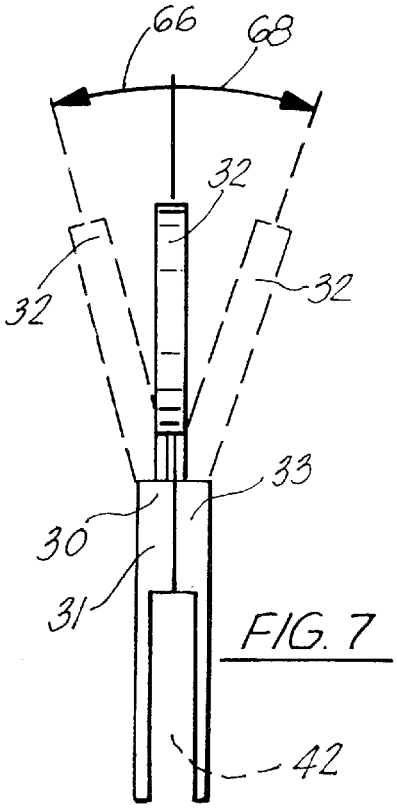

FIG. 7 illustrates yet an additional movement that is able to be achieved by the ring 32 due to the ball and socket relationship between the base 30 and the ring 32. As illustrated in side view, the base portion 30, is seen with the ring 32, in complete vertical alignment above the body 30. However, should the tube undertake any up or down tilt in its path, the ring 32 is able to move, for example, in an angulated position 66 away from the vertical to a second angulated position as seen by arrows 68 from the vertical. Therefore, it is clear that as seen in FIGS. 5, 6 and 7, because of the ball and socket relationship between the base 30 and the ring 32, the ring has the ability to move in a complete 360 degree rotational movement, in a movement at an angle from left to right of the vertical, i.e. a horizontal movement, or in a movement from the vertical to the front or rear of the vertical, depending upon the path of the tube that is being supported by the various assemblies as seen in FIG. 1.

PARTS LIST

The following is a list of suitable parts and materials for the various elements of the preferred embodiment of the present invention.

| | |
|---|---|
| assembly | 10 |
| barrier | 12 |
| base portion | 14 |
| central portion | 16 |
| flat upper surface | 18 |
| anti-glare panels | 20 |
| base portion | 22 |
| anti-glare panel portion | 24 |
| upper surface | 26 |
| lighted tube | 28 |
| base portion | 30 |
| first half portion | 31 |
| upper tube support portion | 32 |
| second half portion | 33 |
| ring member | 34 |
| inner bore | 36 |
| outer wall portion | 38 |
| interior bore | 40 |
| channel | 42 |
| point | 44 |
| screws | 46 |
| circular opening | 50 |
| stem member | 52 |
| housings | 54 |
| semi-circular opening | 56 |
| circular cavity | 57 |
| socket | 58 |
| circular member | 60 |
| arrows | 61 |
| horizontal portions | 62 |
| left position | 62 |
| outermost edges | 64 |
| right position | 65 |
| angulated position | 66 |
| arrow | 68 |

The foregoing embodiments are presented by way of example only; the scope of the present invention is to be limited only by the following claims.

I claim:

1. An assembly for supporting a lighted tube along a highway, comprising:

a. a base portion, securable to a fixed location adjacent the highway;

b. a support portion, mounted to the base portion, the support portion supporting a section of the lighted tube;

c. means interconnecting base portion and support portion, for allowing vertical, horizontal and rotational movement of the support portion in relation to the base portion.

2. The assembly in claim 1, further comprising a plurality of said assemblies positioned at spaced apart intervals along the length of the lighted tube for supporting the entire length of the tube.

3. The assembly in claim 1, wherein the means interconnecting the base portion and the support portion further comprises a ball and socket joint.

4. The assembly in claim 1, wherein the support portion further comprises a ring member having an inner diameter substantially the outer diameter of the lighted tube for slidingly securing the tube within the ring.

5. The assembly in claim 1, wherein the base portion further comprises a channel for positioning a standard anti-glare panel within the channel and securing the base portion to the anti-glare panel.

6. The assembly in claim 1, wherein the base portion is constructed of two half portions, together defining the base portion, and securing the ball connection within a socket formed in the base portion.

7. The assembly in claim 1, wherein the base portion is secured to a fixture adjacent the highway, such as a glare panel, through screw attachments or the like.

8. The assembly in claim 1, wherein vertical, horizontal and rotational movement of the support portion accommodates any misalignment along the length of the lighted tube as the tube is supported along a section of highway.

9. An assembly for supporting a lighted tube along a highway, comprising:

a. a base portion, securable to a fixed location, such as an anti-glare panel, positioned adjacent the highway;

b. a support portion, mounted to the base portion, the support portion supporting a section of the lighted tube within a support ring;

c. means interconnecting the base portion and support portion, for allowing vertical, horizontal and rotational alignment of the support portion in relation to the base portion while supporting the lighted tube within the support ring.

10. The assembly in claim 9, wherein the means interconnecting the base portion and the support portion further comprises a ball and socket joint.

11. The assembly in claim 9, wherein the base portion further comprises a channel for positioning a standard anti-glare panel within the channel and securing the base portion to the anti-glare panel.

12. The assembly in claim 9, wherein the base portion is constructed of two half portions, together defining the base portion, and securing the ball connection within a socket formed in the base portion.

13. The assembly in claim 9, wherein the base portion is secured to a fixture adjacent the highway, such as a glare panel through screw attachments or the like.

14. The assembly in claim 9, wherein the vertical, horizontal and rotational alignment of the support portion accommodates any misalignment along the length of the lighted tube as the tube is supported along a section of highway.

15. A support assembly, comprising:

a. a base portion, securable to a fixed location adjacent the highway;

b. a support portion, mounted to the base portion, the support portion further comprising a ring portion;

c. means interconnecting the base portion and support portion, for allowing vertical, horizontal and rotational movement of support portion in relation to the base portion; and d. a lighted tube, extending a distance along a highway, with spaced apart portions of the lighted tube supported through the ring portions of the support portion of a plurality of support assemblies, so that any misalignment of the lighted tube along its length is accommodated by the vertical, horizontal and rotational movement of each support portion supporting a portion of the lighted tube.

16. The assembly in claim 15, wherein the ring portion includes an inner diameter substantially the outer diameter of the lighted tube for slidingly securing the tube within the ring portion.

17. The assembly in claim 15, wherein the base portion further comprises a channel for positioning a standard anti-glare panel within the channel and securing the base portion to the anti-glare panel.

18. The assembly in claim 15, wherein the base portion is constructed of two half portions, together defining the base portion, and securing the ball connection within a socket formed in the base portion.

19. The assembly in claim 15, wherein the base portion is secured to a fixture adjacent the highway, such as a glare panel through screw attachments or the like.

20. A support assembly for lighted tubes mounted adjacent highways, the support assembly further comprising a support ring for securing the lighted tube therein, and a base member, the support ring secured to the base member so as to allow vertical, horizontal and rotational movement of the support ring relative to the base member to accommodate any misalignment of the lighted tube along its length.

* * * * *